US005209791A

United States Patent [19]

Masumoto et al.

[11] Patent Number: 5,209,791

[45] Date of Patent: May 11, 1993

[54] PROCESS FOR PRODUCING AMORPHOUS ALLOY FORMING MATERIAL

[75] Inventors: Tsuyoshi Masumoto, 3-8-22, Kamisugi, Aoba-ku, Sendai-shi, Miyagi; Akihisa Inoue, Sendai; Junichi Nagahora, Yokohama; Kazuhiko Kita, Sendai, all of Japan

[73] Assignees: Tsuyoshi Masumoto, Sendai; Yoshida K.K., Tokyo, both of Japan

[21] Appl. No.: 816,709

[22] Filed: Dec. 30, 1991

[30] Foreign Application Priority Data

Jan. 10, 1991 [JP] Japan ..... 3-18207

[51] Int. Cl.[5] ..... C22F 1/04; C22F 1/16

[52] U.S. Cl. ..... 148/561; 419/29

[58] Field of Search ..... 148/403, 561; 419/29

[56] References Cited

U.S. PATENT DOCUMENTS

| | | | |
|---|---|---|---|
| 4,311,539 | 1/1982 | Uedaira et al. | 148/561 |
| 5,043,027 | 8/1991 | Gerling et al. | 148/561 |
| 5,053,084 | 10/1991 | Masumoto et al. | 148/561 |
| 5,074,935 | 12/1991 | Masumoto et al. | 148/403 |

*Primary Examiner*—George Wyszomierski

*Attorney, Agent, or Firm*—Flynn, Thiel, Boutell & Tanis

[57] ABSTRACT

A process for producing an amorphous alloy forming material having at least 50% by volume of an amorphous phase which comprises a first-stage treatment in which an amorphous alloy is maintained in a temperature range below the glass transition temperature, a second-stage treatment in which the alloy is maintained in a temperature range in the supercooled liquid region for a prescribed period of time, and quenching of the alloy thus treated. The process improves the embrittlement peculiar to amorphous alloys subjected to thermal hysteresis for a long time and provides amorphous alloys having excellent strength, ductility and thermal plastic workability.

6 Claims, 6 Drawing Sheets

PROCESS FOR PRODUCING AMORPHOUS ALLOY FORMING MATERIAL

BACKGROUND OF THE INVENTION

1. Field of the Invention

The present invention relates to a process for producing an amorphous alloy forming material for the purpose of improving any amorphous alloy in its inherent embrittlement during high temperature working of the alloy in which the alloy is subjected to thermal hysteresis for a long time.

2. Description of the Prior Art

Some of the present inventors invented Al—transition metal element (hereinafter abbreviated as "TM")-rare earth metal element (hereinafter abbreviated as "Ln") alloys and Mg—TM—Ln alloys as lightweight high-strength amorphous alloys and applied for patents as Japanese Patent Laid-Open No. 275732/1989 and Japanese Patent application No. 220427/1988, respectively. Also, they invented Al—TM—Ln alloys and Zr—TM—Al alloys as alloys with high strength and excellent workability and applied for patents as Japanese Patent Application Laid-Open Nos. 36243/1991 and 158446/1991, respectively. Having high strength and high corrosion resistance, these alloys exhibit glass transition behavior and possess a supercooled liquid region, and therefore show favorable workability in the above region or at temperatures in the neighborhood of the region. Thus, these alloys obtained in the form of powder or thin strips can be easily subjected to consolidation-forming and cast into amorphous bulk material, which is also an excellent alloy showing good workability in the supercooled liquid region or at temperatures in the neighborhood thereof.

When maintained in the supercooled liquid region for a long time, however, the above-mentioned amorphous alloys begin to decompose into crystals, thus restricting the working time for consolidation-forming, working-forming, etc. As a means for avoiding the above problem, a method of consolidation-forming or working-forming at a temperature below the glass transition temperature is available. As is the case with general amorphous alloys, the alloys in question are characterized in that when heated to a high temperature region slightly below the glass transition temperature, they suddenly lose the ductility peculiar thereto and embrittle. Since the amorphous alloys that are subjected to consolidation-forming or reworking-forming at high-temperatures cannot sufficiently exhibit their inherent properties, an improvement in their properties has been desired.

It is known that an amorphous alloy generally embrittles when heated to high temperatures just below the glass transition temperature, even if lower than the crystallization temperature. The phenomenon is attributable to the structural change toward the more stable atomic configuration in spite of its being amorphous, and in general relates to the structural relaxation. The structural relaxation is in a state of reversible and irreversible reactions mixed with each other. Though the reversible reaction is canceled by rapidly heating to a high temperature, the structural relaxation takes place in an extremely short time, followed by another structural relaxation at another temperature, which is not preventable by simple reheating, and therefore is difficult to avoid.

SUMMARY OF THE INVENTION

An object of the present invention is to provide a process for the production by consolidation-forming or working-forming of an amorphous alloy material such as amorphous alloys obtainable in various shapes of powder or thin bodies or amorphous bulk material obtainable through casting by solving the problem of embrittlement due to the aforestated structural relaxation without the loss of the characteristics including ductility inherent to the amorphous alloy itself.

In view of the above, the present invention solves the problem of embrittlement of an alloy due to the structural relaxation caused by the thermal hysteresis such as the heat treatment or high-temperature working in the first-stage by the second-stage treatment of reheating the alloy to the temperature range in the supercooled liquid region thereof.

Specifically, the present invention provides a process for producing an amorphous alloy forming material comprising subjecting an amorphous alloy material having a supercooled liquid region to a first-stage treatment in which the material is maintained in a temperature range lower than the glass transition temperature thereof, subsequently subjecting it to a second stage treatment in which the material is maintained in a temperature range in the supercooled liquid region (in the range of the glass transition temperature to the crystallization temperature) for a prescribed period of time and then quenching it to produce a forming material having at least 50% by volume of an amorphous phase.

DETAILED DESCRIPTION OF THE PREFERRED EMBODIMENTS

Figure 1:
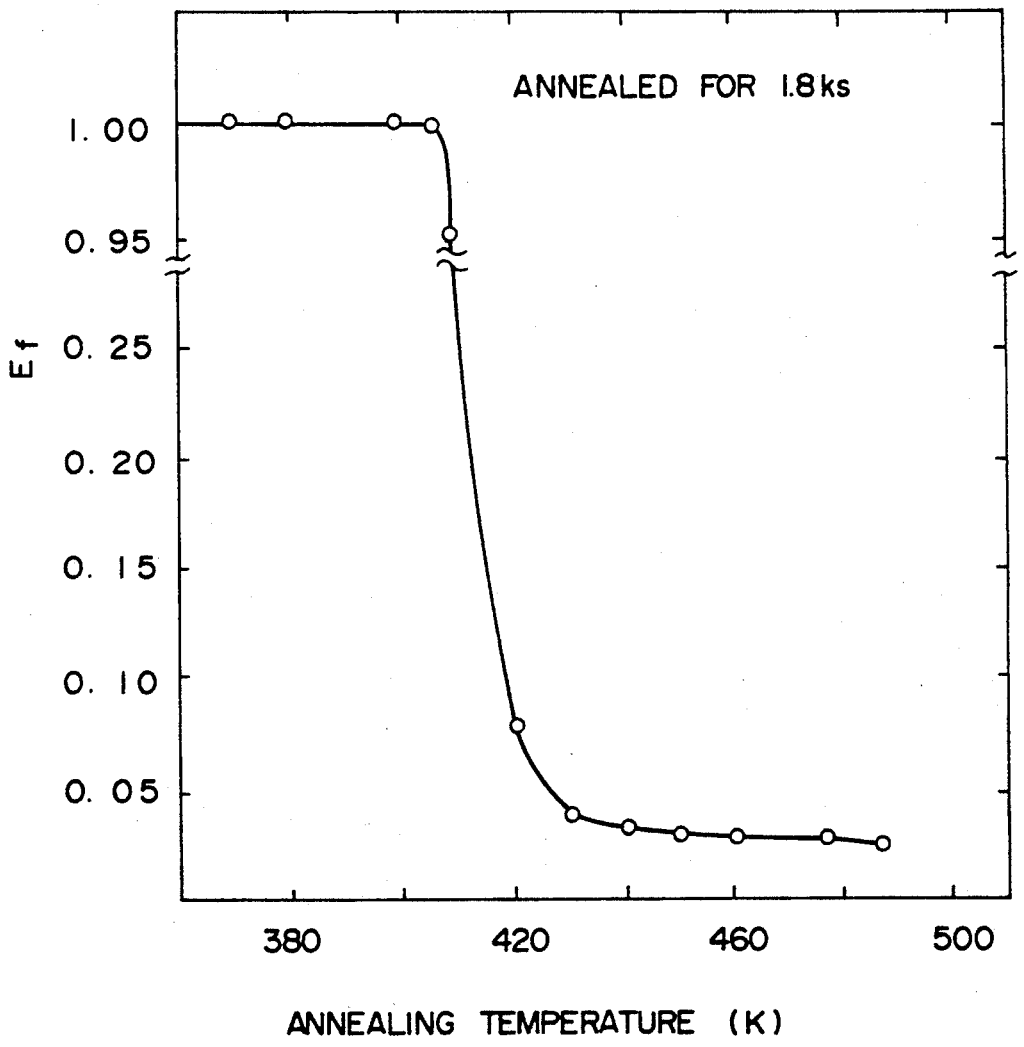
FIG. 1 is a graph showing the results of testing for the ductility of the test pieces of an example according to the present invention.

The present invention is particularly effective for an amorphous alloy having a supercooled liquid region which is obtained by the conventional well-known quenching solidifying method such as melt spinning method, submerged spinning method or gas atomizing method and exemplified by Al—TM—Ln alloys disclosed in Japanese Patent Laid-Open No. 275732/1989, Mg—TM—Ln alloys disclosed in Japanese Patent Laid-Open No. 220427/1988. Al—Tm—Ln alloys disclosed in Japanese Patent Laid-Open No. 171298/1989 and Zr—TM—Al alloys disclosed in Japanese Patent Laid-Open No. 297494/1989, and also is applicable to other amorphous alloys showing a supercooled liquid region.

The amorphous alloy obtained by the above method is decomposed into crystals by heating. By the term "glass transition temperature" (Tg) as used herein is meant the initiation point of an endothermic peak appearing prior to crystallization in a differential scanning calorimetry curve obtainable by heating at a temperature rise rate of 40° C. per minute. By the term "crystallization temperature" (Tx) is meant the initiation point of the first exothermic peak in a differential scanning calorimetry curve. By the term "supercooled liquid region" is meant the region ranging from the glass transition temperature to the crystallization temperature. These amorphous alloys have each different glass transition temperatures and crystallization temperatures depending on the alloy species or the composition thereof.

It is well known that, in general, an amorphous alloy remains amorphous when heated to a temperature below the Tg thereof but shows a structural change toward a more stable atomic configuration causing the so-called structural relaxation, which is interpreted as the phenomenon wherein a part of the free volume introduced during the formation of the amorphous structure is released by heating accompanied with a slight increase in density. Reportedly, the above structural relaxation is reversible and can be canceled by heating to a higher temperature. However, the cancellation is restricted to the conditions such that the heating is effective for the structural relaxation at relatively low temperatures only and requires a precise control of the heat treatment conditions with a short holding time. The structural relaxation is accompanied by the loss of ductility peculiar to amorphous alloys and embrittlement. Once the amorphous alloy is embrittled by heating, it is no longer capable of exhibiting the inherent characteristics thereof.

On the other hand, since the constituent elements of the alloy have each a very high diffusion rate assuming a liquid phase in the supercooled liquid region, the alloy shows a large deformation under a low stress and is utilized for consolidation-forming and plastic working of alloy powder, etc. However, this cannot be the optimum process for commercial production because severe restriction of time and strict control of temperature, etc., are required for the prevention of crystallization in the supercooled liquid region.

There is proposed, therefore, the production at a temperature below the glass transition temperature which can alleviate the restriction to the production condition for the prevention of the crystallization, but causes unsuitable embrittlement owing to the aforestated structural relaxation.

The present invention can be accomplished by utilizing the combination of the behavior of the alloy at a temperature below the Tg with the properties thereof in the supercooled liquid region. More specifically, in the first-stage treatment, an amorphous alloy with a supercooled liquid region is held or subjected to consolidation-forming or other working at a temperature below the glass transition temperature thereof, resulting in embrittlement due to structural relaxation. In the second-stage treatment, the alloy is heated to a temperature in the supercooled liquid region and held for prescribed period of time, and the structural relaxation caused in the first-stage treatment is eliminated by the supercooled liquid state thus formed. Subsequently, the alloy is quenched from the temperature in the supercooled liquid region to an ordinary temperature by a suitable way such as water cooling ad the supercooled liquid structure is retained as such as low as ordinary temperatures with the restored ductility.

The foregoing first- and second-stage treatments may be continuous or discontinuous, but the final quenching must be carried out rapidly immediately after the second-stage treatment. The treatment temperature in the first stage may be an arbitrary temperature below the glass transition temperature, but the highest possible temperature is advantageous in the case where the treatment is accompanied by some working. (In this case, it is necessary to take into consideration the heat of working due to the deformation of the material.) As a general rule, the first-stage treatment is carried out desirably in the temperature range from (Tg-100K) to Tg for 3000 sec or less. The first-stage treatment can be put into practice by the use of an electric furnace, other furnaces, oil bath or salt bath, and in the case where some working accompanies, it can be effected by the use of a processing apparatus such as a hot press, forging apparatus or extruding apparatus.

It will suffice when the second-stage treatment is conducted within the supercooled liquid region, but the treatment at an unnecessarily high temperature or for an unnecessary long time involves the possibility of crystallization. The temperature range in the supercooled liquid region varies depending on alloy species. In general, the second stage treatment is carried out desirably in the temperature range from a temperature higher than the Tg to the crystallization temperature for 4 to 100 sec. Although the rate of raising the temperature to that in the second stage is not specifically limited, it is preferably higher in the case of a relatively narrow supercooled liquid region (5 to 10K) as is the case with Al—Ni—Ln alloys. This is because the effect of rapid heating in raising the crystallization temperature and enlarging the supercooled liquid region can be utilized thereby. The second-stage treatment can be put into practice by the use of the apparatuses used in the first-stage treatment, but a method in which electric current is directly passed through the workpiece is particularly effective for rapid heating.

In order to obtain a sound amorphous material, it is effective to utilize in working the easy plastic fluidity in the supercooled liquid region, for example, in the second-stage treatment further pressurization or working-forming is applied in combination or simultaneously with the disappearance stage of the structural relaxation.

The quenching after the second-stage treatment can be carried out by conventional water cooling or any other method with the equivalent cooling rate.

The process of the present invention is applicable to any amorphous alloy having a supercooled liquid region other than those hereinbefore described.

EXAMPLE

By the use of an alloy $La_{55}Al_{25}Ni_{20}$ wherein each subscript denotes the atomic percentage of each element, a ribbon of 0.05 mm in thickness and 1.5 mm in breadth was prepared by liquid quenching (melt spinning) to be used as a test piece. The test piece was analyzed by means of an X-ray diffraction analyzer, and the result revealed a broad diffraction pattern peculiar to an amorphous phase, proving the amorphism of the test piece. As the result of analysis by differential scanning calorimetry at a temperature rise rate of 40° C. per minute, the test piece has a glass transition temperature of 476K and a crystallization temperature of 545K.

The test piece was subjected to the first-stage treatment at a temperature in the range of 360 to 490K for 1800 sec to measure the ductility or brittleness. The ductility was evaluated by bending the test piece in the direction of thickness, interposing it between two parallel flat plates, gradually bringing the plates closer until the bent or folded parts of the piece are brought into close contact with each other and observing the breaking point of the test piece. The bending strain at the breaking point is expressed as follows:

$$Ef = t/(L-t)$$

where,

Ef: bending strain t: ribbon thickness

L: distance between the plates

The result is given in FIG. 1 as the function of annealing temperature. When the ribbon is not broken even at a bending angle of 180 degrees, the Ef is "1" showing the ductility of the ribbon. An Ef value less than "1" shows embrittlement. As given in the figure, the Ef value sharply drops at 416K and reaches an almost constant value of 0.03 at 434K and higher, proving the occurrence of harmful embrittlement at 416K.

Figure 2:
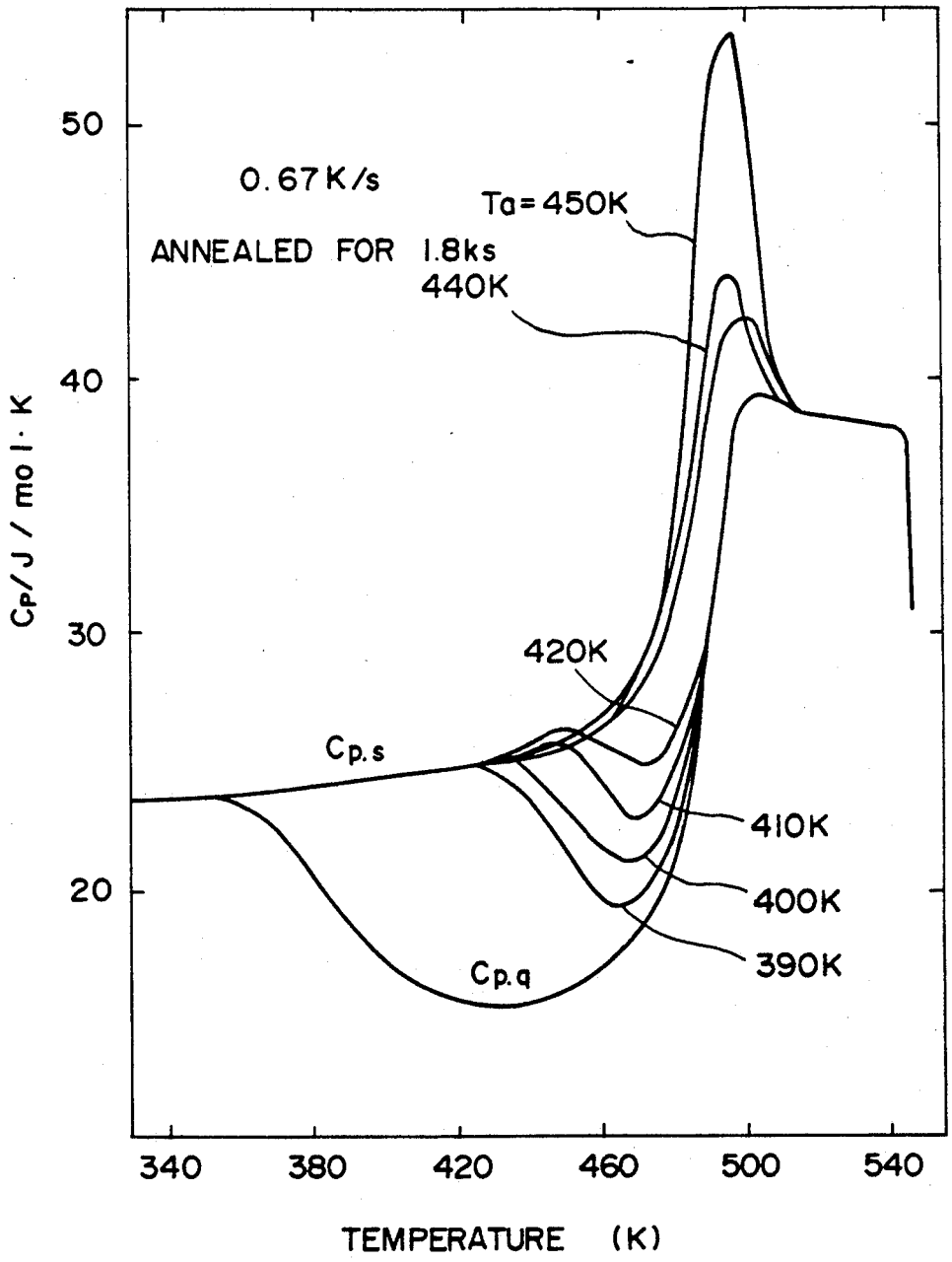
FIG. 2 is a graph showing the thermal analysis curves of ribbons.

The thermal analysis curve of the ribbon without heat treatment (marked with Cp.q) and those of the ribbons with heat treatment at each annealing temperature (Ta) of 390 to 450K for 1800 sec are given in FIG. 2. A thermal analysis curve marked with Cp.s is that of the ribbon subjected to heating up to the glass transition temperature (Tg) and then cooling down so as to produce a complete structural relaxation and, as shown in FIG. 2, the curve (Cp.s) has a second highest endothermic peak. As seen from the figure, the specific heat of the ribbon without heat treatment (Cp.q) is 22.5 J/mol.K at room temperature but decreases with the rise of temperature at 350 owing to structural relaxation, reaches the minimum at 434K, gradually increases up to 460K, sharply increases between 470 and 500K accompanying glass transition, reaches the maximum of 37.0 J/mol.K at 515K corresponding to the supercooled liquid region and steeply decreases at 545K on account of crystallization. On the contrary, the three ribbons subjected to the first-stage heat treatment at each annealing temperature of 390, 400 and 410K, respectively, each being lower than the Tg exhibit ductility and form an amorphous phase leaving an unrelaxed state which produces structural relaxation during the subsequent reheating. The remaining unrelaxed amorphous phase is the contributor to the ductility still maintained after the reheating. The two ribbons heat-treated at 440 and 450K, respectively, do not exhibit structural relaxation at all during reheating but exhibit endothermic peaks at 460 to 500K showing the increase in the specific heat due to the destruction of the structural relaxation, which took place during aging, by reheating. This proves that the almost perfect progress of the structural relaxation occurred in the first-stage heat treatment, which corresponds to the brittleness seen in the FIG. 1. As is the case of the ribbon heated-treated at 450° C. for 1800 sec, since materials in a structural relaxation state have a short-range order structure, energy is required to eliminate such a structural relaxation state and establish a liquid state. Therefore, this structural change endothermic as can be seen from the thermal analysis curve for the ribbon heat-treated at 450° C.

Figure 3:
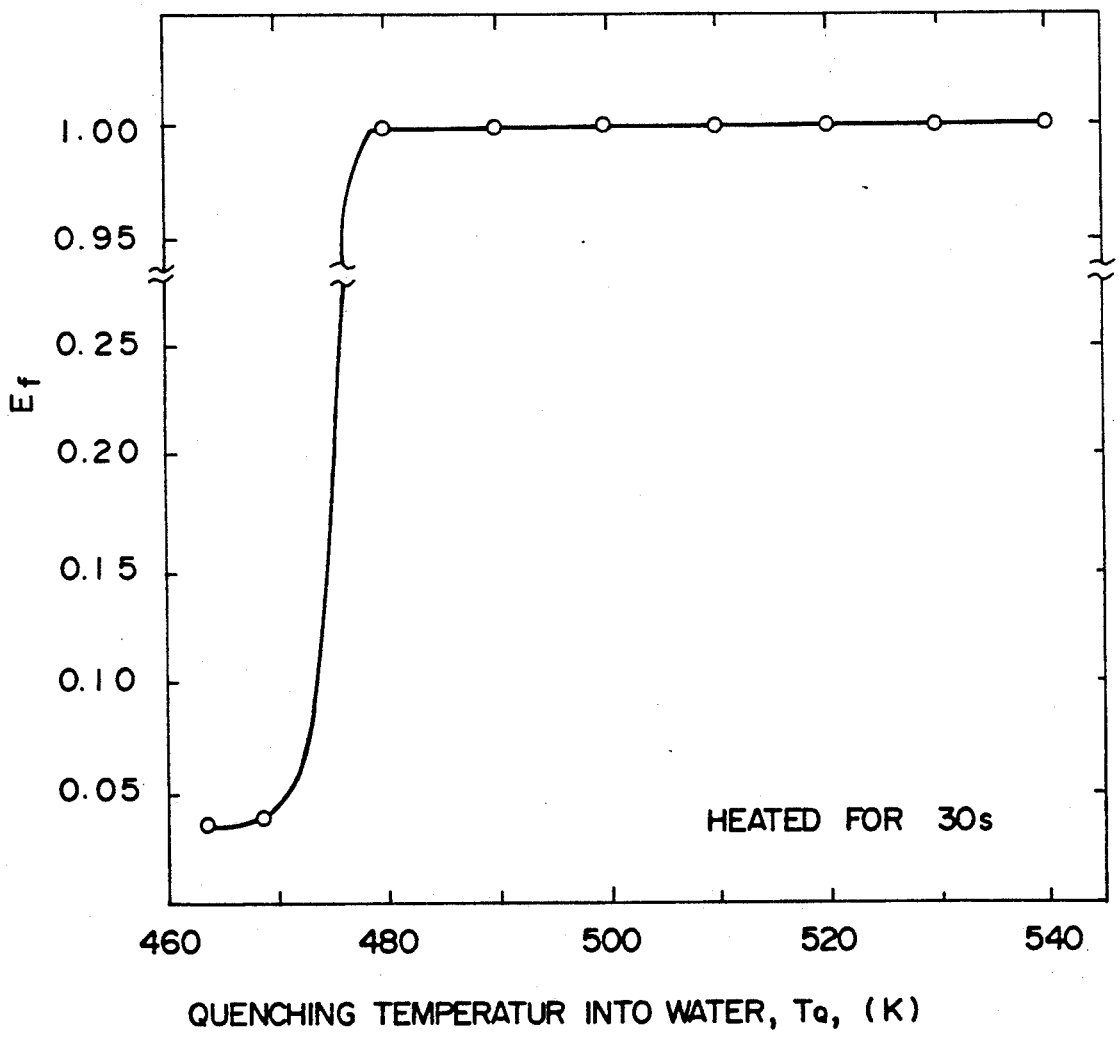
FIG. 3 is a graph showing the results of testing for the ductility of a ribbon after the second-stage treatment.

The ribbons heat-treated at 450K were further subjected to the second-stage heat treatment at 465 to 540K, respectively, for 30 sec and quenched in water to evaluate the Ef value. The result is given in FIG. 3. As seen from the figure, the ribbons heat-treated at 480 to 540K, that is, in the supercooled liquid region, resumed an Ef value of "1" proving that the ductility lost in the first-stage treatment was resumed in the second-stage treatment.

Figure 4:
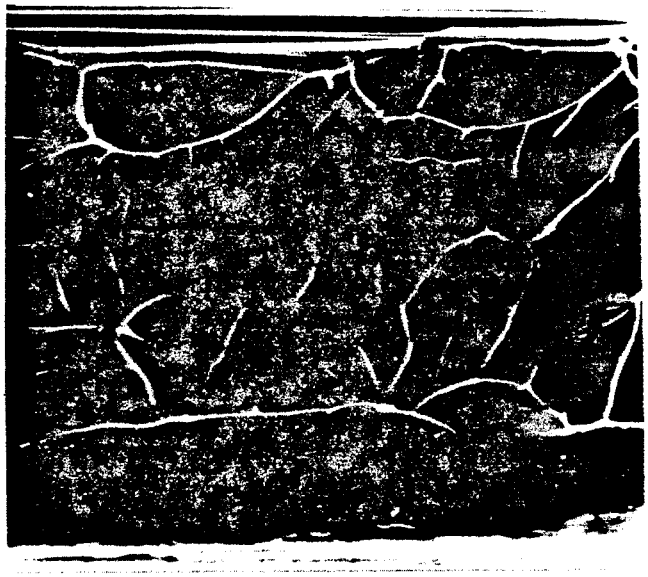
FIG. 4 is a microphotograph showing the metallic structure of a ribbon without any heat treatment.
Figure 5:
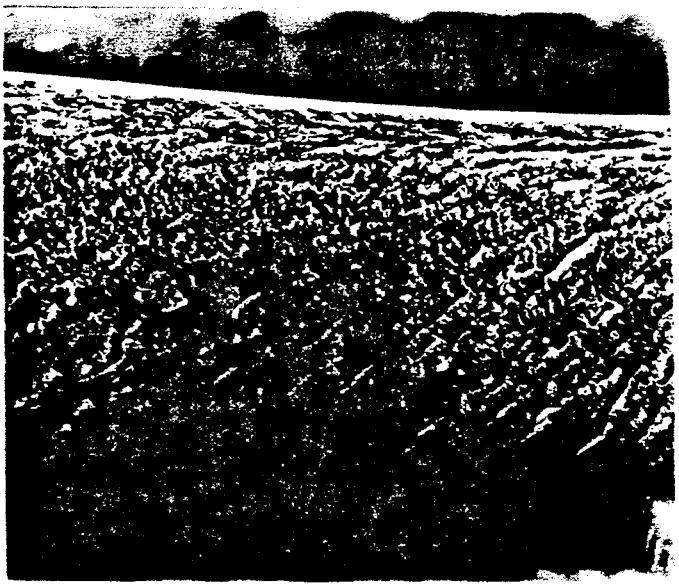
FIG. 5 is a microphotograph showing the metallic structure of a ribbon with the first-stage treatment.
Figure 6:
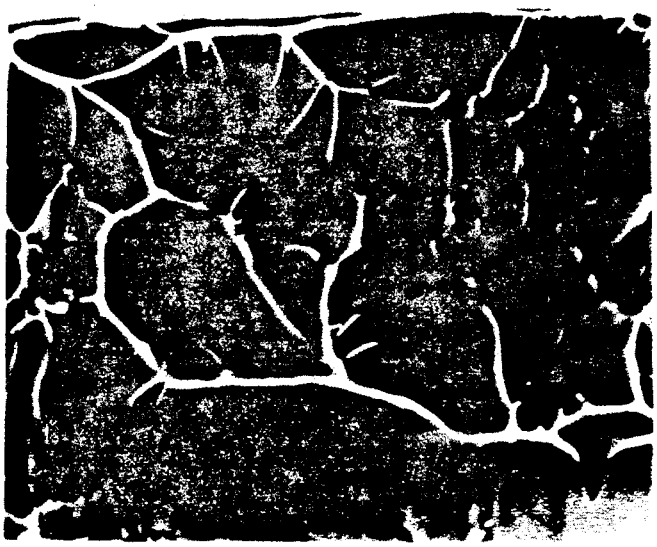
FIG. 6 is a microphotograph showing the metallic structure of a ribbon with the second-stage treatment.
Figure 7:
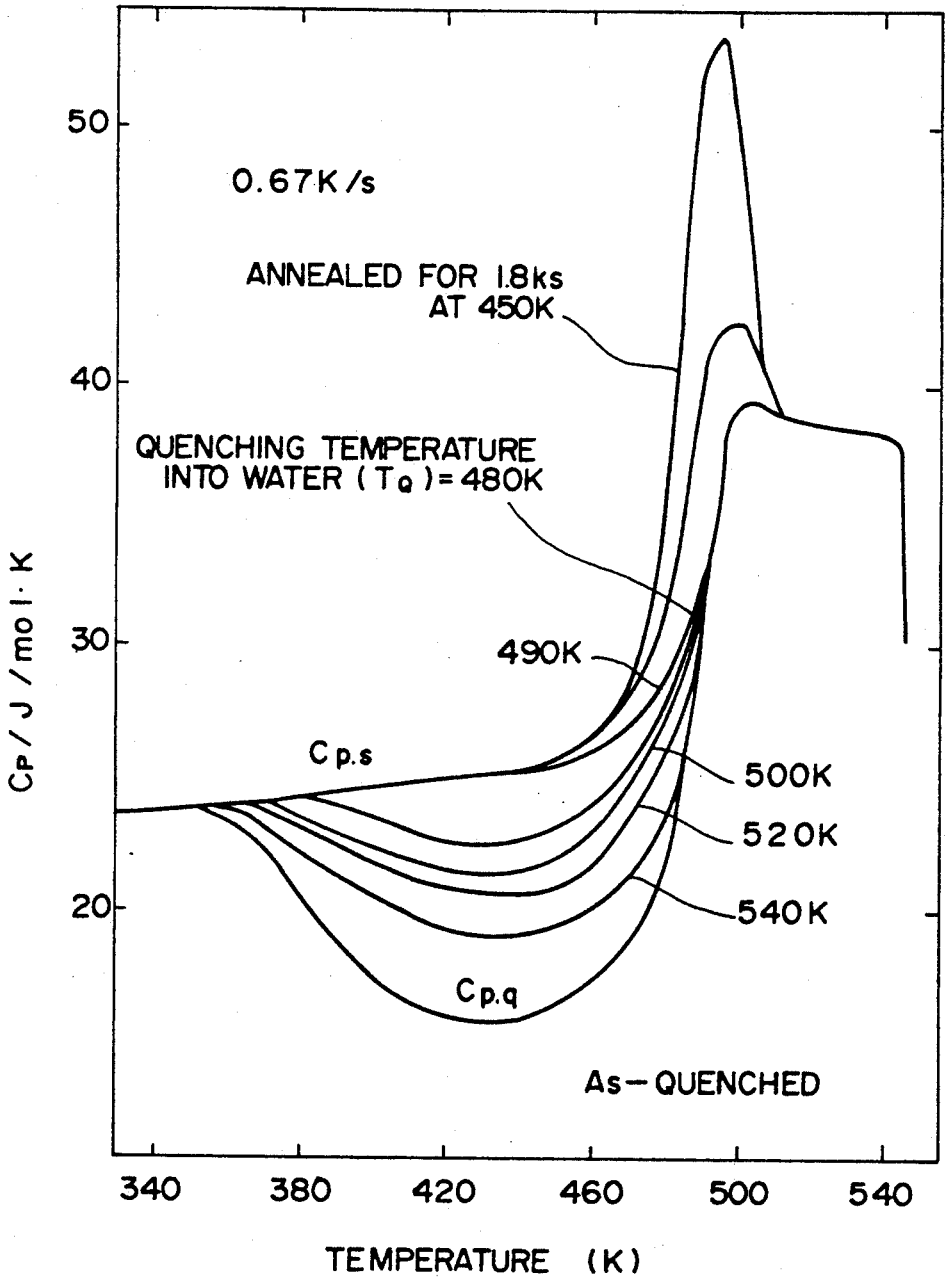
FIG. 7 is a graph showing the thermal analysis curves of ribbons with the second-stage treatment.

FIGS. 4, 5 and 6 give microphotographs with a scanning electron microscope of tensile rupture cross-sections of the ribbon without any heat treatment, the ribbon with the first-stage treatment (450K, 1800 sec) and the ribbon with the second-stage treatment (510K, 30 sec) and quenching in water, respectively. FIG. 4 exhibits a pulse-like pattern peculiar to the ductile fracture of an untreated ribbon. FIG. 5 gives that of the ribbon subjected to the first-stage treatment, showing a shell-like pattern peculiar to brittle fracture. FIG. 6 gives that of the ribbon after the second-stage treatment, regaining ductile fracture. FIG. 7 gives thermal analysis curves of the ribbons subjected to the first-stage treatment (450K, 1800 sec) followed by the second-stage treatment for 30 sec each at a temperature in the supercooled liquid region. In any of the curves, any endothermic peak showing the development of structural relaxation was not observed, which proves that the unrelaxed amorphous structure was resumed by the second-stage treatment. In FIG. 7, thermal analysis curves marked with $C_{p.q}$ and $C_{p.s}$ are those shown in FIG. 2.

As seen from the aforestated Examples, it has been confirmed that the embrittlement accompanying the structural relaxation caused by the first-stage treatment is canceled by the second-stage treatment followed by quenching into water and the ductility is resumed. Likewise, the foregoing effect is exhibited on the amorphous Al—TM—Ln, Mg—TM—Ln and Zr—TM—Al alloys.

The process according to the present invention serves to resume the ductility which is lost with the structural relaxation caused by heat hysteresis during consolidation-forming or other plastic working at an elevated temperature of amorphous alloys obtainable in the form of various powder or thin strips and can provide amorphous alloys having excellent strength, ductility and thermal plastic workability.

What is claimed is;

1. A process for producing an amorphous alloy product comprising the steps of subjecting an amorphous alloy material having a supercooled liquid region to a first stage treatment in which said amorphous alloy material is maintained in a temperature range of from the amorphous alloy material's glass transition temperature minus 100°K to the amorphous alloy materials's glass transition temperature for a period of time of from the minimum time necessary to result in embrittlement in the amorphous alloy material due to structural relaxation therein to 3000 seconds; subsequently subjecting the amorphous alloy material to a second-stage treatment in which said amorphous alloy material is maintained in a temperature range of from higher than the amorphous alloy material's glass transition temperature to the amorphous alloy material's crystallization temperature for 4 to 40 seconds; and quenching said amorphous alloy material to produce an amorphous alloy product having at least 50% by volume of an amorphous phase.

2. The process according to claim 1, wherein the amorphous alloy material is a powder with a definite form of a sphere or flake, or a powder with an indefinite form and is subjected to consolidation-forming of sintering or compaction in the first-stage treatment.

3. The process according to claim 2, wherein the amorphous alloy material is subjected to final consolidation-forming or final-forming of pressurizing or working, in the second-stage treatment.

4. The process according to claim 1, wherein the amorphous alloy material is in a thin strip form or a consolidated form and is subjected to plastic working by consolidation-forming of pressure welding or extrusion, forging or pressing in the first-stage treatment to be formed into a prescribed shape.

5. The process according to claim 4, wherein the amorphous alloy material is subjected to final consolidation-forming or final-forming of pressurizing or working, in the second-stage treatment.

6. The process according to claim 1, wherein the amorphous alloy material is that of Al—TM (transition metal element)—Ln(rare earth metal element) alloy, Mg—TM—Ln alloy or Zr—TM—Al alloy.

* * * * *